United States Patent [19]

Ljokkoi et al.

[11] Patent Number: 4,995,991

[45] Date of Patent: Feb. 26, 1991

[54] METHOD AND APPARATUS FOR IMPROVING THE OPERATION OF A DISC FILTER

[75] Inventors: Risto Ljokkoi, Karhula; Tapani Niiranen, Savonlinna, both of Finland; Pekka Purho, Tokyo, Japan; Erkki Savolainen, Haapakallio; Jari Siitonen, Jyväskylä, both of Finland

[73] Assignee: Ahlstrom Corporation, Noormarkku, Finland

[21] Appl. No.: 326,311

[22] Filed: Mar. 21, 1989

[30] Foreign Application Priority Data

Mar. 22, 1988 [FI] Finland ..... 881348

[51] Int. Cl.[5] ..... B01D 33/26; B01D 29/76

[52] U.S. Cl. ..... 210/797; 210/145; 210/331; 210/407; 210/486

[58] Field of Search ..... 210/106, 107, 108, 331, 210/332, 391, 392, 407, 409, 791, 797, 91, 739, 746, 89, 346, 486, 145, 147, 769, 772; 134/144, 148, 33

[56] References Cited

U.S. PATENT DOCUMENTS

| | | | |
|---|---|---|---|
| Re. 27,326 | 4/1972 | Sheaffer | 210/91 |
| 1,804,934 | 5/1931 | Hoyt | 210/331 |
| 2,096,314 | 10/1937 | Banks et al. | 210/91 |
| 3,121,681 | 2/1964 | Baxter | 210/332 |
| 3,193,105 | 7/1965 | Putnam | 210/332 |
| 4,060,483 | 11/1977 | Barzuza | 210/791 |
| 4,276,166 | 6/1981 | Muller et al. | 210/332 |
| 4,519,910 | 5/1985 | Ragnegaro et al. | 210/332 |
| 4,676,901 | 6/1987 | Ragnegard | 210/331 |

FOREIGN PATENT DOCUMENTS

| | | | |
|---|---|---|---|
| 1146197 | 11/1967 | United Kingdom | 210/331 |
| 8807887 | 10/1988 | World Int. Prop. O. | 210/791 |

*Primary Examiner*—Frank Spear
*Assistant Examiner*—Joseph Drodge
*Attorney, Agent, or Firm*—Cohen, Pontani & Lieberman

[57] ABSTRACT

A disc filter and method of operating same is provided in which a liquid jet is intermittently used to detach pulp cake from the disc filter. In operation, mechanical or electrical means actuate a nozzle to spray pressurized fluid at a portion of the boundary between the surface of each disc filter segment and its associated pulp cake. The nozzle is actuated to begin spraying as respective segments move into register with the nozzle and are cause to discontinue spraying prior to moving out of register when the loosened pulp cake falls from the segments by gravity. the improved control of pulp cake removal reduces use of washing fluid and results in improved pulp cake consistency.

15 Claims, 2 Drawing Sheets

METHOD AND APPARATUS FOR IMPROVING THE OPERATION OF A DISC FILTER

BACKGROUND OF THE INVENTION

The present invention relates to a method and an apparatus for improving the operation of a disc filter. In particular the invention relates to increasing the discharge consistency of fiber suspensions treated with disc filters in the paper and pulp industry.

Disc filters have been known and used for decades, for example in the wood processing industry. For instance the disc filters are disclosed in British patent specification No. 1,146,197 and in U.S. Pat. No. 3,193,105 are typical examples of this. Even the construction of the filters has during recent years become nearly uniform throughout the industry. In recent times the major improvements in disc filters have been in the development of new materials. Even in the earliest disc filters, a jet of water or corresponding liquid was used to detach the cake of pulp from the surface of a filter sector. For a layman this may seem illogical as the consistency of the pulp cake is of course reduced when liquid is added to it. There have been attempts to detach the cake with air but that has proved to be more expensive than the cost of using water and the cost resulting from the dilution of the pulp caused by the use of water. Thus the users of disc filters have been compelled to accept the fact that even though the consistency of the pulp cake can be raised to 15–16% on the surface of the filter sector, the consistency of the cake after being detached from the filter, e.g. measured at the discharge screw, is only 11–12%.

When studying modern disc filters it has been discovered that the pulp cake is quickly detached by itself by the force of gravity, if the upper corner of the cake has been separated from the surface of the filter sector. However, all of the disc filters currently available are so constructed that the jet of liquid detaching the pulp cakes from the disc continuously sprays liquid onto the filter surface. Most of this liquid of course passes through the filter surface but part of it is immediately and deleteriously absorbed by the pulp cake, the consistency of which is thus reduced. As mentioned before the consistency of the pulp cake is thus reduced by several per cent which is detrimental to further treatment of the pulp. Also, even though the detaching liquid jet passes through the filter surface when the pulp cake is no longer attached at that point to the filter surface, a major part of the liquid runs back through the filter surface as there is no suction inside the filter sector to remove the liquid to the filtrate.

We have discovered that the regulation of the volume of the detaching liquid jet will achieve savings in the cost of pumping of the detaching liquid and will also desirably result in the maintenance of the consistency of the pulp to the maximum consistency reached by the filter itself.

Performed tests have shown that it is possible to use the detaching liquid jet intermittently so as to apply it only for about one third of the time. Hence the amount of the liquid to be injected is reduced to a third and it is estimated that the volume of the liquid absorbed by the pulp cake is reduced to about one-half of the volume absorbed with conventional injection method. Thus if the consistency in the detaching stage is reduced by conventional methods by 4 per cent, the reduction of the consistency with the method and the apparatus of the present invention is only approximately 2 per cent.

The method of improving the operation of a disc filter according to the present invention is characterized in that the detaching pressure medium jet is only intermittently on, thereby resulting in a reduction in the use of detaching water whereby the consistency of the pulp discharged from the disc filter is remarkably increased.

The apparatus for improving the operation of a disc filter according to the present invention is characterized in that means for making the pressure medium jet intermittent is disposed in the pressure medium pipe line supplying the nozzle which sprays the detaching liquid, or is in connection with the nozzle itself.

BRIEF DESCRIPTION OF DRAWINGS

The method and the apparatus according to the present invention is described, by way of example, in a more detailed way with reference to the accompanying drawings for which.

DETAILED DESCRIPTION OF PREFERRED EMBODIMENTS

Figure 1:
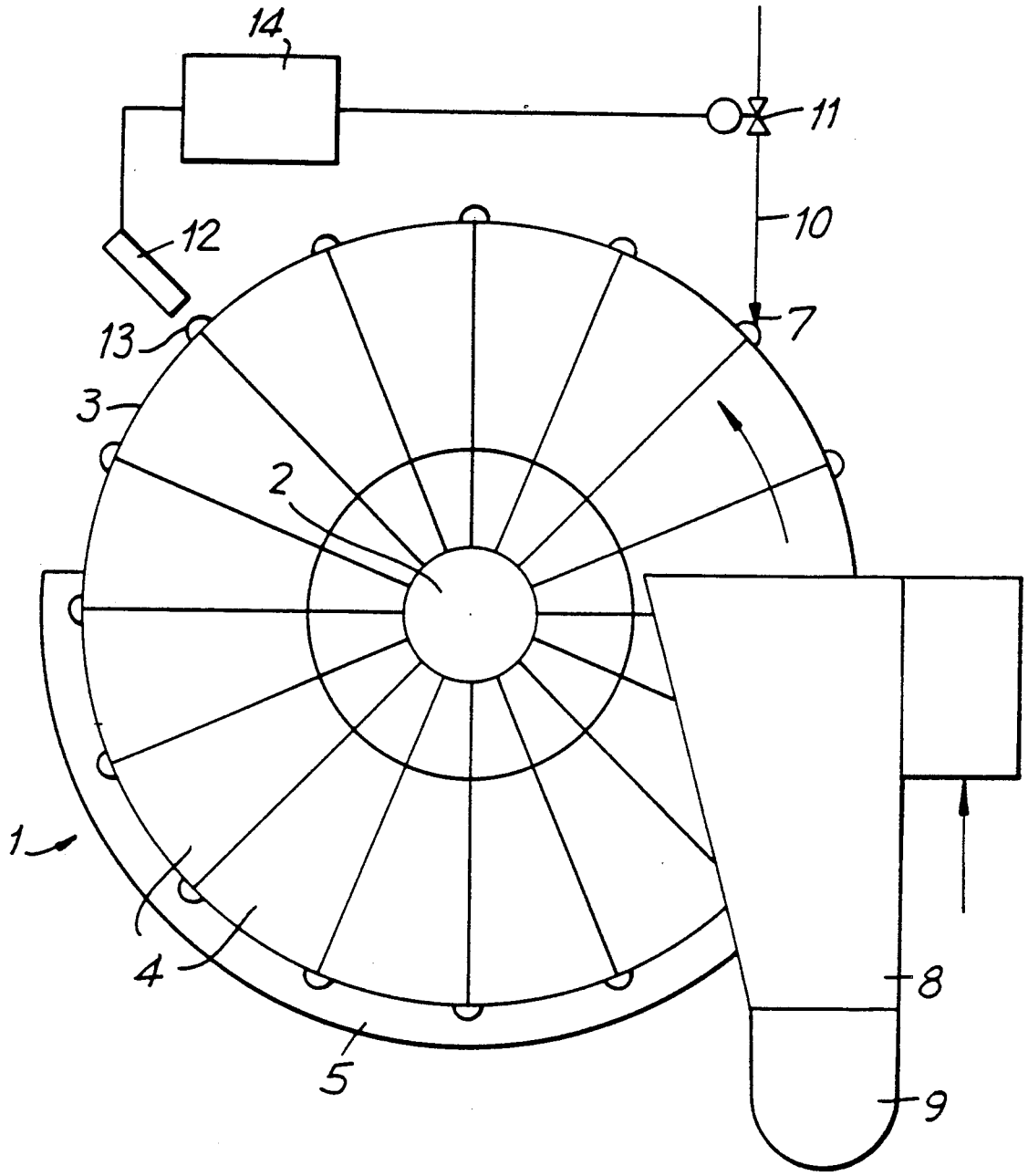
FIG. 1, which is partly in plan and partly diagrammatic, and illustrates a disc filter the apparatus of the present invention by which the method is applied.
Figure 2:
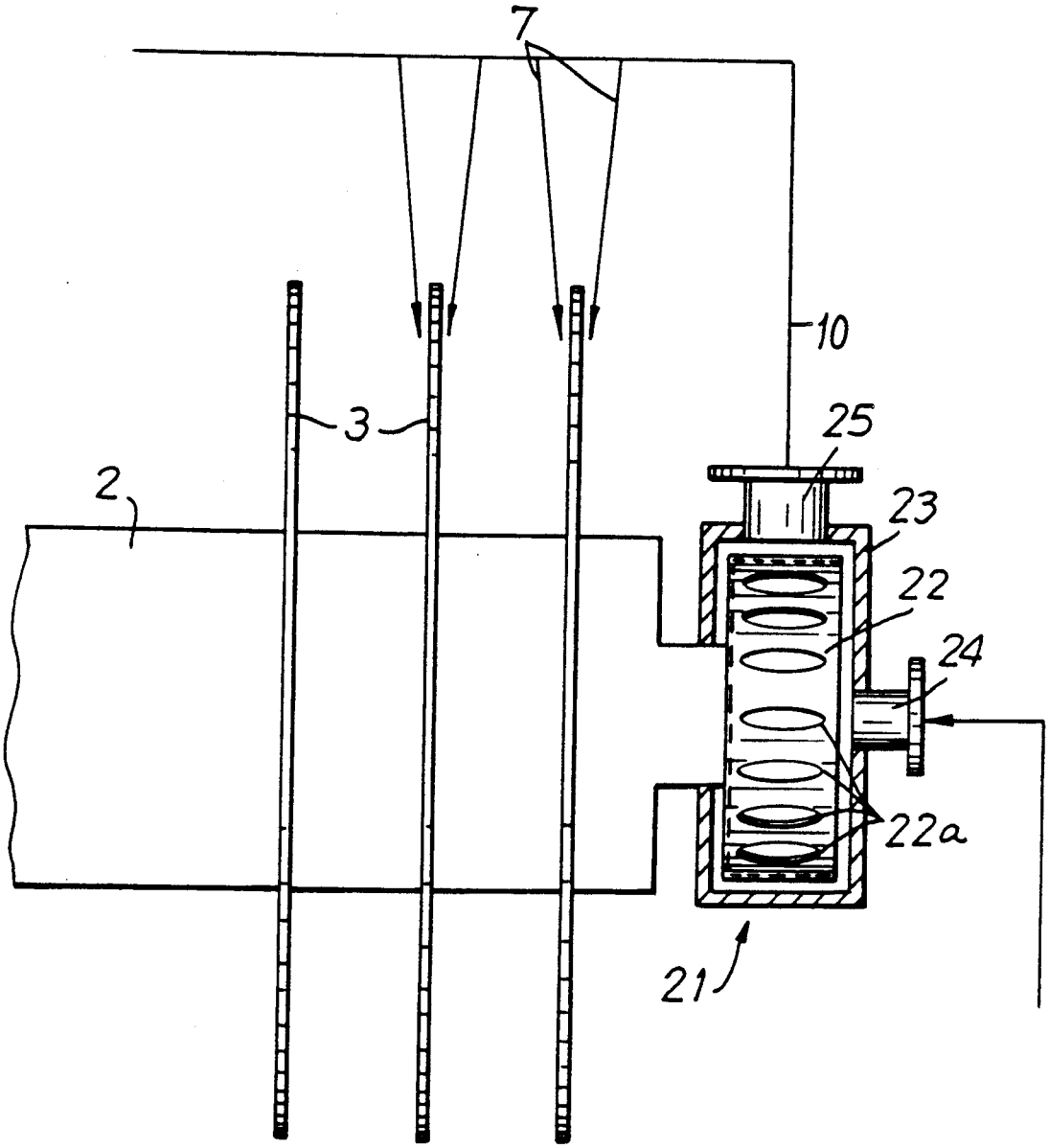
FIG. 2 is a diagrammatic view of disc filters and means for detaching pulp cakes from said disc filters, said means including a valve arrangement of a preferred embodiment of the invention.

The apparatus according to the invention illustrated in FIGS. 1 and 2 includes a disc filter 1, the construction of which may be conventional, which in turn preferably comprises several adjacent filter discs 3 (shown in FIG. 2 as three in number) disposed in turn coaxially on a shaft 2. In FIG. 1, the filter discs 3 include sixteen filter sectors 4, this being a commercially available structure and not critical to the invention. Each filter sector 4 has a hollow inner part which is provided with under pressure for suction of water from a fiber suspension in a basin 5 into the filter sector 4. The basin 5 (omitted in FIG. 2) is formed by the lower portion of the filter 1 and is preferably divided by partition walls (not shown) into compartments, desirably one for each filter disc, and in portions between the compartments via which the pulp cake detached from the disc is transferred further. When the pulp flows towards the filter sector 4 fibers are gathered onto the surface of the sector and during movement of the sector in the basin a cake of pulp is deposited on the surface of the filter sector. When each filter sector 4 rises up in its turn from the liquid the pulp cake is firmly attached to the surface of the sector. The pulp cake is then detached from each filter sector 4 by a detaching pressure medium, in most cases water, from one or several nozzles 7 which are directed at the boundary surface between the sector and the pulp cake. When the pulp cake is detached from the surface of the sector by action of the pressure medium, it drops off into a gutter 8 between the compartment walls between the discs 3 and further onto a transport screw 9 (omitted in FIG. 2).

In accordance with our invention and as already has been stated, it is not necessary to spray the pressure medium, which in fact can be for example air, water or other fluid, continuously onto the surface of the sector 4. Short periodic bursts of pressure medium are sufficient to take the pulp cakes from their respective sectors 4. For this purpose a valve 11 may be provided in pipe 10 for supplying pressure medium to the nozzle (7) or in connection with the nozzle itself with which the spraying of pressure medium is regulated depending on the mutual position of the nozzle/nozzles 7 and the sector 4. Spraying is preferably started when the nozzle 7 is in front of the front edge of the sector 4 (i.e. is in register with the front edge of sector 4) whereby the jet of pressure medium discharged from the nozzle hits the boundary surface of the pulp cake and the sector just at the edge of the pulp cake. The spraying is continued for a period of time until the pulp cake is sufficiently detached from the filter that the force of gravity will complete its removal without any assistance of the pressure medium necessary. Tests have confirmed that this period corresponds to 20 to 70% preferably approximately 30%, of the time it takes the width of a sector to pass by the nozzle 7.

There are a large number of devices for carrying out the operation described above. First of all, the impulse for initiating the spraying can be produced either mechanically or electronically. Thus, in one embodiment, a lever or a corresponding means may be provided in the discs which, together with a micro switch controls an electromagnetic valve regulating the supply of pressure medium. Alternatively, the control impulse may also be given with a cam device arranged on the shaft of the filter. Further, as illustrated in FIG. 1, it is possible to employ a sensor 12, either electromagnetic or capacitive, instead of the lever mentioned above, in which case the sensor generates an impulse in response to the proximity or movement of a pin 13 arranged in the filter disc which impulse controls the electromagnetic valve 11 according to the output of sensor 12. The system is preferably further provided with a control unit 14, i.e. a timer for controlling the period the valve 11 is open. Many other types of sensors, for example thermistors or optical sensors, can also be used. In one form of the invention, the sensor 12 initiates the opening of valve 11 and control unit 14 determines how long valve 11 remains open. Of course, other control arrangements may be employed within the scope of this invention.

It is also possible that the nozzle 7 itself is employed as the immediate device to make the jet intermittent which device opens when the pressure in the pipe line supplying detaching medium to the nozzle increases and closes when the pressure in the pipe line drops below a predetermined value. An example of such an apparatus is illustrated in FIG. 2. The apparatus includes a valve device 21 which comprises a cylindrical housing 22 having apertures 22*a* and is secured to the end of the disc filter shaft 2 or is otherwise driven by said shaft and rotates in a compartment 23. The detaching liquid is brought to the compartment 23 via a connection 24 and is removed from the valve device 21 via a connection 25. The inner surface of the compartment 23 is sealed to the housing 22, especially around the connection 25 so as to let detaching medium flow to the connection 25 only when any of the apertures 22*a* of the housing 22 is in register with the connection 25. The number of the apertures 22*a* of the housing is preferably the same as the number of the filter disc sectors 4. The timing and the spacing of the apertures is preferably chosen to make the detaching liquid jet discharging from the compartment 23 via an aperture 22*a* exactly at the right time and last long enough to detach the pulp cake. Said valve device 21 can of course be used without the pressure-operated nozzle with an ordinary inexpensive hole nozzle.

Also ending the spraying period can be realized either directly mechanically (FIG. 2), as by moving the registered aperture 22*a* out of register with said connection 25 with electrical means, with or without a conventional timer (FIG. 1), in which an experimentally determined spraying period may be set and which is in most electrical devices easy to adjust, contrary to the mechanical alternative illustrated in FIG. 2. For instance, one way to adjust the spray period in the FIG. 2 embodiment is to adjust the size of the apertures 22*a*.

Further, it is possible that each filter disc is provided with a control valve 11 of its own, whereby pumping of pressure medium can be carried out with a smaller pump when it is possible to phase the spraying periods Also, the filter discs can be arranged in groups, each group having one guide valve of its own for the entire group; or all the nozzles of the whole disc filter can be controlled with one valve. The most advantageous alternative has been proved to be arranging the filter discs in groups and controlling the operation of the nozzles of a few discs 2 with one valve whereby only a few valves are needed and the operation of the nozzles of different disc groups can still be phased relative to each other and the flow volume of the detaching medium pump maintained also constant all the time.

As the above description discloses, a new type of an arrangement for detaching a pulp cake from the sectors of a disc filter has been devised, with which arrangement the consistency of the pulp cake can be raised by a few per cents compared with prior art methods. However, only a few alternative embodiments have been described above, by way of example; other alternative embodiments will now readily suggest themselves to persons of ordinary skill in the art. The examples given here already clearly reveal the broad scope of the invention, the scope of protection being determined by the appended patent claims, only.

What is claimed is:

1. A method of detaching pulp cakes from the surface of a rotating disc filter that is divided into a plurality of segments which are sequentially immersed in a basin containing fiber suspension to pick up said fiber from said suspension to form pulp cakes on said segments, said method comprising:

directing a jet of pressurized fluid at a portion of the boundary between the filter surface and the pulp cake for dislodging said pulp cake from the filter for a time beginning when the leading edge of each of said pulp cakes registers with said jet and discontinuing said jet prior to each of said pulp cakes moving out of register with said jet and allowing the remainder of said pulp cake to fall from the filter by action of gravity.

2. The method of claim 1, wherein the time for directing said jet at each of said pulp cakes is between about 20% and 70% of the time it takes one of said pulp cakes to pass by said jet.

3. The method of claim 2, wherein the time for directing said jet at each of said pulp cakes is between about 30% and 50% of the total time it takes said pulp cake to pass by said jet.

4. The method of claim 1, wherein said fluid jet is a water jet.

5. Apparatus for forming pulp cakes, comprising a basin for containing a fiber suspension;

a rotatable disc filter having a horizontal shaft and a plurality of disc filter segments, said disc filter being partially disposed within said basin for forming a pulp cake on each of said disc filter segments as said disc filter rotates each segment into and out of fiber suspension in said basin;

a nozzle means connected to a supply of pressurized fluid, for directing a jet of said pressurized fluid at a portion of the boundary between the surface of each disc filter segment and the pulp cake formed thereon; and means for automatically turning on and off said jet of pressurized fluid in timed relation with the rotation of said disc filter for applying said pressurized fluid to said boundary between said disc filter surface and said pulp cake and for separating said pulp cake from said filter surface.

6. The apparatus of claim 5, wherein said pressurized fluid is water.

7. The apparatus of claim 6, further comprising at least one additional nozzle.

8. The apparatus of claim 6, wherein said rotatable disc filter is mounted on a shaft for rotation therewith, and further comprising at least one additional segmented filter-disc mounted on said shaft for rotation therewith and at least one additional nozzle, said additional nozzle being directed at the boundary between the surface of said additional filter disc and the pulp cakes formed thereon;

means for connecting said other nozzle to said pressurized fluid, so that said other nozzle can direct another jet of said pressurized fluid at the surface of said other disc; and means for automatically turning on and off said other jet in timed relation with the rotation of said other disc filter.

9. The apparatus of claim 8, wherein said means for turning on and off said jet and said means for turning on and off said other jet are one and the same means.

10. The apparatus of claim 8 wherein the shaft is horizontal.

11. The apparatus of claim 6, wherein said means for turning on and off said jet comprises a valve controlling the supply of pressurized fluid to said nozzle, and means for detecting the angular position of the filter disc relative to said nozzle for controlling the valve in accordance with said relative angular position.

12. The apparatus of claim 11, wherein the means for turning on and off said jet comprises a rotating cylindrical housing having apertures in its periphery and being driven by the shaft of the disc filter, a chamber surrounding said housing, said housing being sealed inside said surrounding chamber, which chamber having connections for supplying the detaching pressure medium to and for discharging the detaching pressure medium from said rotatable housing.

13. The apparatus of claim 5, wherein the rotatable disc filter is mounted on a horizontal shaft for rotation therewith.

14. The apparatus of claim 13, wherein said pressurized fluid is water.

15. The apparatus of claim 14, further comprising at least one additional nozzle.

* * * * *